US009640886B2

(12) United States Patent
Ohyama

(10) Patent No.: US 9,640,886 B2
(45) Date of Patent: May 2, 2017

(54) FITTING CONFIRMATION CONSTRUCTION FOR CONNECTORS

(75) Inventor: Kouichi Ohyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 615 days.

(21) Appl. No.: 13/604,017

(22) Filed: Sep. 5, 2012

(65) Prior Publication Data

US 2013/0005172 A1 Jan. 3, 2013

Related U.S. Application Data

(63) Continuation of application No. PCT/JP2011/058380, filed on Mar. 25, 2011.

(30) Foreign Application Priority Data

Mar. 31, 2010 (JP) ..... 2010-080953

(51) Int. Cl.
*H01R 12/79* (2011.01)
*H01R 13/627* (2006.01)
*H01R 13/641* (2006.01)

(52) U.S. Cl.
CPC ..... *H01R 12/79* (2013.01); *H01R 13/6272* (2013.01); *H01R 13/641* (2013.01)

(58) Field of Classification Search
CPC ..... H01R 12/79
USPC ..... 439/350–358
See application file for complete search history.

(56) References Cited

U.S. PATENT DOCUMENTS

| | | | | |
|---|---|---|---|---|
| 6,840,797 | B2 * | 1/2005 | Ueda et al. | 439/495 |
| 2003/0194899 | A1 | 10/2003 | Ueda | |
| 2004/0002255 | A1 | 1/2004 | Ueda et al. | |
| 2008/0009171 | A1 | 1/2008 | Tsuji | |

(Continued)

FOREIGN PATENT DOCUMENTS

| | | | |
|---|---|---|---|
| CN | 1471198 | A | 1/2004 |
| JP | 5-343133 | A | 12/1993 |
| JP | 11-260456 | A | 9/1999 |

(Continued)

OTHER PUBLICATIONS

International Search Report (PCT/ISA/210), issued by the International Searching Authority in corresponding International Application No. PCT/JP2011/058380 on Jul. 7, 2011.

(Continued)

*Primary Examiner* — Ross Gushi
(74) *Attorney, Agent, or Firm* — Sughrue Mion, PLLC

(57) ABSTRACT

In a fitting confirmation construction, a lock arm is provided in a housing of a first connector. The lock arm includes a lock wall inclined and disposed at a front end of the lock arm in a direction from the first connector toward the second connector; a deflection space formed at a rear of the lock wall in the direction; and an operation plate disposed on the deflection space. A confirmation opening is provided in a rear wall of the housing, and has a height equal to a height of the deflection space. A lock projection is provided on a second connector to be brought into engagement with the lock wall. A rear end face of the operation plate is exposed to a rear outside of the housing of the first connector through the confirmation opening, only in a state where the lock arm is deflected.

6 Claims, 6 Drawing Sheets

(56) References Cited

U.S. PATENT DOCUMENTS

2010/0053386 A1 3/2010 Sizukuisi

FOREIGN PATENT DOCUMENTS

| | | | |
|---|---|---|---|
| JP | 2003-308924 | A | 10/2003 |
| JP | 2004-363044 | A | 12/2004 |
| JP | 2006-85989 | A | 3/2006 |
| JP | 3854529 | B2 | 12/2006 |
| JP | 2002-025707 | A | 1/2012 |

OTHER PUBLICATIONS

Written Opinion (PCT/ISA/237) of the International Searching Authority, issued in corresponding International Application No. PCT/JP2011/058380 on Jul. 7, 2011.
Office Action dated Mar. 4, 2014, issued by the Japanese Patent Office in counterpart Japanese Application No. 2010-080953.
Office Action, dated Jun. 5, 2014, issued by the State Intellecutal Property Office of the People's Republic of China in counterpart Chinese Application No. 201180017484.5.
Office Action dated Jan. 15, 2015 issued by the State Intellectual Property Office of the People's Republic of China in counterpart Chinese Application No. 201180017484.5.

* cited by examiner

FITTING CONFIRMATION CONSTRUCTION FOR CONNECTORS

CROSS REFERENCE TO RELATED APPLICATION

This application is a continuation of PCT application No. PCT/JP2011/058380, which was filed on Mar. 25, 2011 based on Japanese Patent Application (No. 2010-080953) filed on Mar. 31, 2010, the contents of which are incorporated herein by reference. Also, all the references cited herein are incorporated as a whole.

BACKGROUND OF THE INVENTION

1. Technical Field

The present invention is related to a fitting confirmation construction for connectors. The fitting confirmation construction enables the confirmation of whether connectors are fittingly connected together completely or incompletely from the rear by employing a confirmation opening in a connector.

2. Background Art

Conventionally, various types of fitting confirmation constructions have been proposed as ones used in connecting together a connector installed at an end of a flexible flat circuit element to a connector installed at an end of a hard printed circuit board.

For example, JP-A-2006-85989 describes a fitting confirmation construction. In this construction, a plurality of terminals of conductive metal are disposed in parallel in a circuit-board-side connector so as to be exposed to an inside of a mating connector insertion port. A terminal of a flat circuit element is fixedly held between upper and lower guide members of a flat-circuit-element-side connector. At the same time as both the connectors are fitted together, the terminals of the circuit-board-side connector are brought into elastic contact with a plurality of exposed conductors of the flat circuit element within the mating connector insertion port, and a projection on a flexible lock arm of the flat-circuit-element-side connector is brought into elastic engagement within a hollow portion in an upper wall of the circuit-board-side connector. Then, the worker is allowed to recognize a complete fitting connection of the connectors by hearing an engagement sound and visually confirming the projection.

In addition, JP-A-2003-308924 describes a locking construction for a flat-circuit-element-side connector. In this locking construction, locking piece portions are provided at distal ends of a pair of left and right substantially L-shaped flexible leg portions, and lock releasing levers are folded back in parallel to the leg portions from both left- and right-hand sides of the locking pieces portions.

In addition, JP-A-5-343133 describes a fitting confirmation construction. In this construction, an opening and an inclined guide rib are provided in an upper wall of one of connectors for not a flat circuit element but a wiring harness connection connectors, and a flexible arm which follows the guide rib and a mark at a distal end of the arm are provided in the other connector, so that when connectors are fitted together, the mark is caused to be positioned within the opening for recognition by the worker who fits the connectors together. JP-A-2004-363044 also describes a fitting confirmation construction in which when connectors are fitted together, a different colored portion of the other connector is positioned within an opening in one connector.

SUMMARY OF THE INVENTION

In the conventional fitting confirmation constructions described in the above patent documents, however, like an example shown in FIG. 12, for example, when circuit-board-side connectors 18 are fixedly placed at one end of a hard circuit board 38, since an other circuit board package part 41 is disposed in front of the connectors 18, and additionally, like an example shown in FIG. 13, when at least two upper and lower circuit boards 38, 38' are disposed one above the other, since the upper and lower circuit boards 38, 38' are connected together by connecting walls 42 at left- and right-hand side portions, when a flat-circuit-element-side connector 1' of a mating flat circuit element is fittingly connected to the lower circuit-board-side connector 18, the visual confirmation from the top or the front or sides as indicated by arrows C, D cannot be implemented due to the upper circuit board 38', the other circuit board package part 41 and the connecting walls 42. Thus, like an example shown in FIG. 14, whether or not both the connectors 1', 18 are fitted together properly has to be confirmed visually from a direction indicated by arrow E, that is, from the rear in an inserting direction of the flat-circuit-element-side connector 1', causing a problem that the visual confirmation on whether or not both the connectors 1', 18 are fitted together properly is difficult.

In addition, the way of confirming the proper connectors fitting connection by visually confirming the movement of the marked arm as described in JP-A-5-343133 or the differently colored housing as described in JP-A-2004-363044 has caused a problem that costs involved become high. The "rear" is referred to as so when the distal end side of the flat-circuit-element-side connector 1' is referred as "front" and the direction in which the flat circuit element 22 is led out is referred to as "rear."

It is therefore one advantageous aspect of the present invention to provide a fitting confirmation construction which enables a visual confirmation of proper connectors fitting connection, for example, in fittingly connecting one connector such as a flat-circuit-element-side connector to the other connector such as a circuit-board-side connector in the fittingly connecting direction or from the rear of the one connector simply and in an ensured fashion and moreover, with a simple and low-cost construction.

According to one aspect of the present invention, there is provided a fitting confirmation construction for confirming a connection between a first connector and a second connector, the fitting confirmation construction comprising:

a lock arm, provided in a housing of the first connector, and including:

a lock wall inclined and disposed at a front end of the lock arm in a direction from the first connector toward the second connector;

a deflection space formed at a rear of the lock wall in the direction; and an operation plate disposed on the deflection space;

a confirmation opening, provided in a rear wall of the housing, and having a height equal to a height of the deflection space; and a lock projection, provided on the second connector, and configured to be brought into engagement with the lock wall, wherein a rear end face of the operation plate is exposed to a rear outside of the housing of the first connector through the confirmation opening, only in a state where the lock arm is deflected.

The fitting confirmation construction may be configured such that: the lock arm includes a right arm and a left arm which connect the lock wall with the operation plate respectively; and lower inclined faces of the right arm and the left arm are exposed to the rear outside through the confirmation opening at a lower end side of the confirmation opening, only in the state where the lock arm is deflected.

The confirmation opening may be a mold removal cavity.

The fitting confirmation construction may be configured such that: the first connector is a flat element circuit side connector; and the second connector is a circuit board side connector.

According to the present invention, when both the connectors are fitted together incompletely, the lock projection is situated in an intermediate position on the inclined face of the lock arm of the lock arm, and the lock arm is deflected within the deflection space. Then, the operation plate portion of the lock is lowered, and a rear end face of the operation plate portion approaches to be situated very close to the confirmation opening in the housing of the one connector in front thereof, whereby the rear end face of the operation plate portion can be visually confirmed within the confirmation opening from the rear (directly rear) of the one connector. When both the connectors are fitted together completely, the lock projection is brought into engagement with a rear side of the lock wall, and at the same time the lock arm is restored, whereby the operation plate portion is raised so that the rear end face of the operation plate portion is situated in a position lying above the confirmation opening. Thus, the rear end face of the operation plate portion cannot be visually confirmed within the confirmation opening from the rear. By visually confirming these facts, the incomplete or complete fitting connection of both the connectors can easily be detected in an ensured fashion.

According to the present invention, even when the worker stands in an inappropriate position or even when obstacles such as other package parts are lying in front of, above or to sides of the lock are of the connector, by visually confirming the locked condition of the lock arm within the confirmation opening from the rear of the connector and moreover, by visually confirming the rear end face of the operation plate portion which lies right close to the confirmation opening, whether both the connectors are fitted together properly or improperly can be determined easily and in an ensured fashion. Since the confirmation opening results from a mold removal cavity when molding the lock arm of resin, no additional cost has to be incurred, thereby making it possible to confirm that the connectors are fitted together properly with the simple construction and in low cost.

According to the present invention, when both the connectors are fitted together incompletely, the lock arm is deflected, whereby the lower inclined faces of the pair of arm portions are lowered and the lower inclined faces are situated at the lower end side of the confirmation opening. Thus, the lower inclined faces can visually be confirmed at the lower end side of the confirmation opening from the rear or the just rear of the one connector. The rear end face of the operation plate portion is positioned on an upper side of the pair of arm portions within the confirmation opening. When both connectors are fitted together completely, the lock arm is restored, and the lower inclined faces of the pair of arm portions rise to be situated at an upper end side of the confirmation opening, whereby the lower inclined faces of the pair of arm portions can visually be confirmed at the upper end side of the confirmation opening from the rear. This ensures that both the connectors are fitted together.

According to the present invention, by confirming the position of the pair of arm portions within the confirmation opening in addition to the visual confirmation of the rear end face of the operation plate portion as done according to the first aspect, the confirmation of the proper fitting connection of both the connectors can be implemented in a further ensured fashion.

According to the present invention, for example, when, with circuit boards disposed in a plurality of stages, a flat-circuit-element-side connector is fittingly connected to a circuit-board-side connector of a lower circuit board from the rear, even in the event that the confirmation of fitting connection or lock of both the connectors cannot be implemented from the front, top and sides, the proper fitting connection of both the connectors can facilitated and ensured by visually confirming what is occurring within the confirmation opening from the rear.

DETAILED DESCRIPTION OF THE EXEMPLARY EMBODIMENTS

FIGS. 1 to 11B show an embodiment of a fitting confirmation construction according to the invention.

Figure 1:
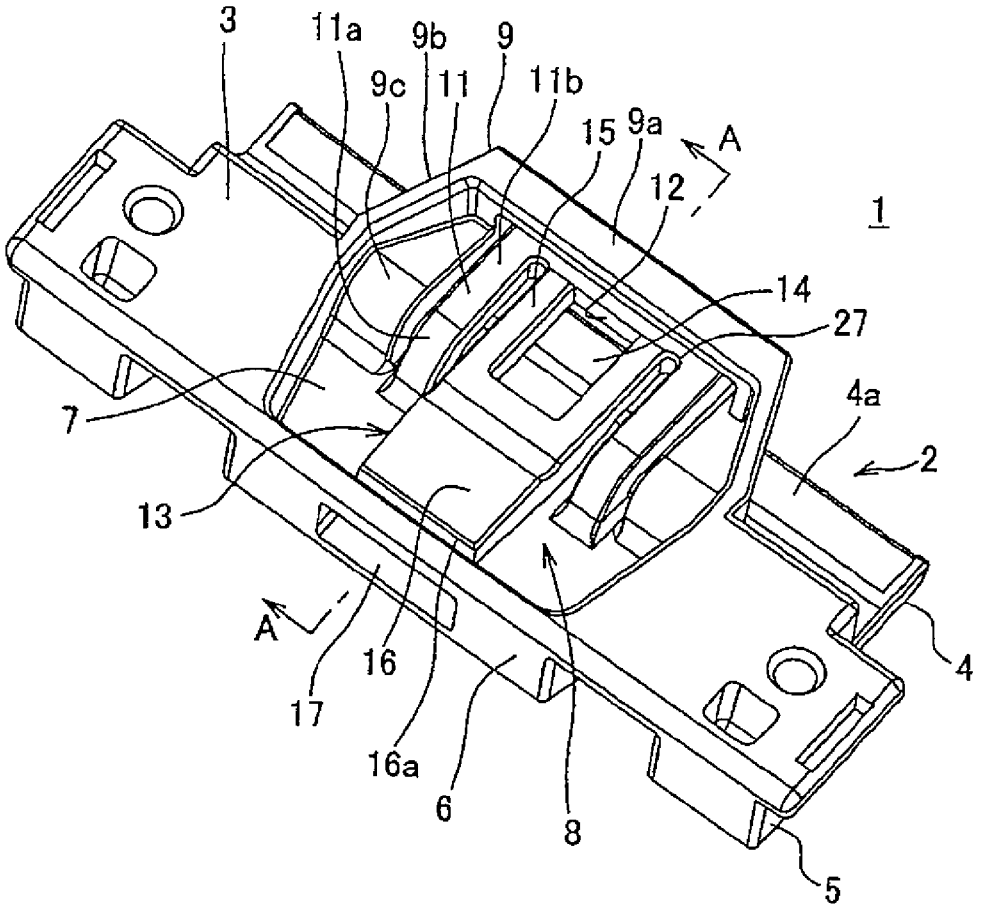
FIG. 1 is a perspective view showing an embodiment of a flat-circuit-element-side connector in a fitting confirmation construction according to the present invention.
Figure 2:
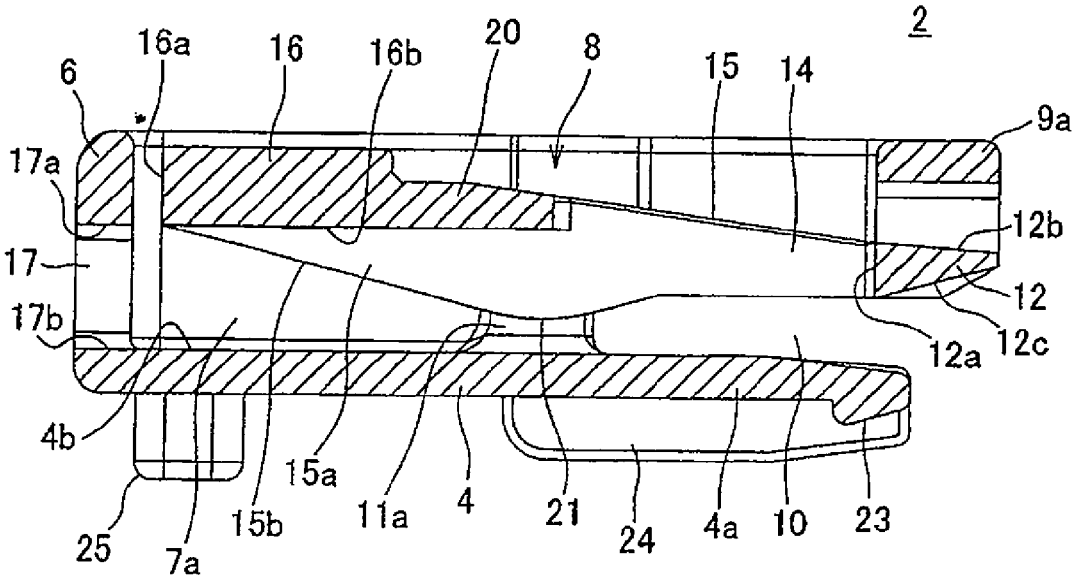
FIG. 2 is a sectional view taken along the line A-A showing the same flat-circuit-element-side connector.
Figure 3:
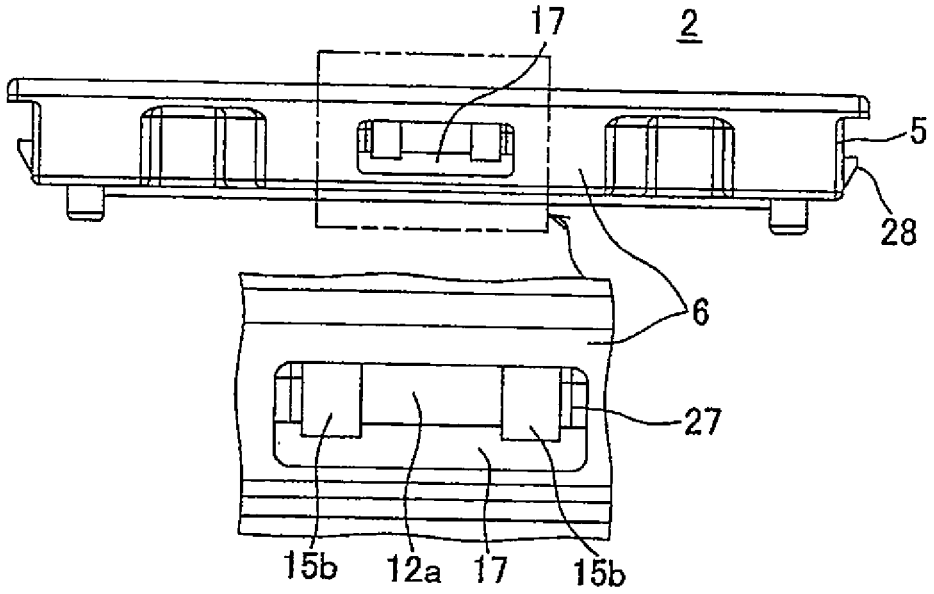
FIG. 3 is a rear view of the same flat-circuit-element-side connector. A lower rear view is an enlarged view of a portion of FIG. 1 which is framed by a chain double-dashed line.

FIGS. 1 to 3 show a form of a housing 2, made of insulating resin, of a flat-circuit-element-side connector 1 (a first connector). As shown in FIG. 1, the housing 2 includes a horizontal upper wall 3 having a laterally elongated rectangular shape, a horizontal bottom wall 4 which is situated below the upper wall 3 so as to face the same wall and which is extended longer to the front than the upper wall 3, left and right vertical side walls 5, a vertical rear wall 6, a flexible lock arm 8 which is placed within a substantially rectangular opening portion 7 in the center of the upper wall 3, an arm protection wall 9 which covers a circumference of the lock arm 8, and a flat mating connector insertion space 10 (FIG. 2) which is defined between the lock arm 8 and an front-half projecting portion 4*a* of the bottom wall 4.

The lock arm 8 has the same shape as that of the conventional lock arm described in JP-A-2003-308924 includes a pair of left and right flexible leg portions 11 each having a substantially L-shape when viewed from a side which rise from the bottom wall 4 of the housing 2 to extend to the front, a lock wall 12 (FIG. 2) which doubles as a connecting wall which connects front ends of the leg portions 11, a lock releasing operation arm 13 which projects to extend a length of the order of twice the leg portion 11 from the lock wall 12 to the rear inside the leg portions 11 and a rectangular lock hollow 14 which is provided over a front-half portion of the operation arm 13 and which employs a rear end face 12*a* (FIG. 2) of the lock wall 12 as a locking plane.

The leg portion 11 includes a curved root portion 11*a* which rises from the bottom wall 4 and a straight portion 11*b* which continues from the root portion 11*a* to extend to the front. The lock wall 12 at a front end of the leg portion 11 is positioned below a front wall 9*a* of the arm protection wall 9 so as to face each other. The operation arm portion 13 includes a pair of left and right narrow straight arm portions 15 which extends from the lock wall 12 to the rear and a rectangular plate-shaped operation plate portion 16 (an operation plate) which extend integrally to the rear of the arm portions 15. The lock hollow portion 14 is positioned between the pair of arm portion 15.

The arm protection wall 9 includes a pair of left and right inclined wall portions 9*b* which project obliquely inwards from a front end the upper wall 3 of the housing, a front wall 9*a* which connects front ends of both the inclined wall portions 9*b* and which projects slightly further forwards than the housing bottom wall 4, and arch-shaped top walls 9*c* which extend in a curved fashion from left and right end portions of the front wall 9*a* to the housing bottom wall 4 along the inclined wall portions 9*b*.

The arch-shaped top walls 9*c* continue integrally to a latter half portion of the housing bottom wall 4 together with the root portions 11*a* of the leg portions 11 of the lock arm 8. An upper side of the later half portion of the housing bottom wall 4 makes the opening portion or space 7 which opens outwards, and the operation plate portion 16 of the operation arm 13 of the lock arm 8 is positioned within the space 7. A rear end face 16*a* of the operation plate portion 16 approaches the front of the housing rear wall 6 so as to face the same wall. A confirmation opening 17 is provided so as to communicate with the space 7 below the rear end face 16*a* of the operation plate portion 16. The confirmation opening 17 is formed as a laterally extended rectangular mold removal cavity for removing a mold for molding a lock arm of resin in this embodiment.

FIG. 2 shows a sectional view taken along the line A-A in FIG. 1. An upper end face 17*a* of the confirmation opening 17 is made free, that is, is positioned on the same horizontal plane as a lower face 16*b* of the operation plate portion 16 of the lock arm 8 when no locking operation is performed, and a lower end face 17*b* of the confirmation opening 17 is positioned on the same horizontal plane as an upper face 4*b* of the housing bottom wall 4. An upper end of the housing rear wall 6 is positioned so as to be level with an upper face of the housing upper wall 3, and an upper face of the operation plate portion 16 is positioned so as to be slightly lower than the upper end of the upper housing rear wall 6.

The lock wall 12 at the front end of the lock arm 8 is positioned so as to lie at a height between the lower face 16*b* of the operation front plate 16 and the upper face 4*b* of the housing bottom wall 4. The lock wall 12 is formed into a beak shape which is pointed in a tapered fashion as it extends towards the front end and has the rear end face 12*a* (the lock face) which is vertical to upper and lower inclined faces 12*b*, 12*c*. The rear end face 12*a* is situated on the same vertical plane as a rear end face of the front wall 9*a* of the protection arm 9. A lock projection 19 is provided on a circuit-board-side connector 18 (a second connector), which is a mating connector, shown in FIGS. 4, 5 and slides along the lower inclined face 12*c* of the lock wall 12.

The confirmation opening 17 is provided to remove to the rear a mold insert (not shown) which is necessary to form a rectangular space (a deflection space) 7*a*, which is horizontal on an upper side and a lower side, between the operation plate portion 16 and the housing bottom wall 4 and the vertical rear end face 12*a* of the lock wall 12 which is situated so as to face the front of the space 7*a*. The operation plate portion 16 and the lock wall 12 are connected together by the left and right arm portions 15 which are inclined downwards as they extend forwards. The arm portions 15 each have a curved support projecting portion 21, which projects towards the bottom wall 4, on a lower side of a portion 20 of the operation plate portion 16 which is lowered by one step at a front end thereof. This support projecting portion 21 continues to a lower portion at a rear end of the operation plate portion 16 by way of a lower inclined face 15*b* of a latter half 15*a* of an arm portion. The latter half 15*a* is an arm portion which is extended integrally on a lower portion of the operation plate portion 16. The root portion 11*a* of the leg portion 11 of the lock arm 8 is situated so as to intersect an intermediate portion of the bottom wall 4 inside the support portion 21. The support projecting portion 21 is brought into abutment with the bottom wall 4 when the lock arm portion 8 is operated to release the lock thereof.

Figure 4:
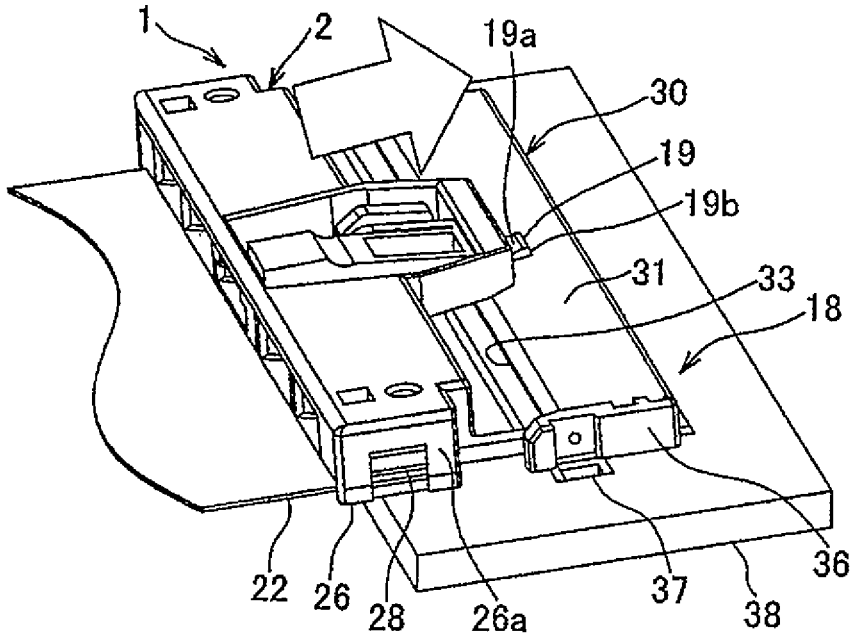
FIG. 4 is a perspective view showing a state in which the flat-circuit-element-side connector is fitted to a circuit-board-side connector.

An elongated projection 23 is provided at a front end of a lower face of the housing bottom wall 4 which is brought into abutment with a flat circuit element 22 shown in FIG. 4 so as to position the same circuit element. A guide rib 24 for guiding the flat circuit element 22 is formed at each of left and right ends of a front half of the bottom wall 4 so as to be suspended vertically downwards therefrom, and bosses 25 for positioning a cover 26 of insulating resin shown in FIG. 4 are provided at a rear portion on the lower face of the bottom wall 4 so as to project downwards therefrom. The flat circuit element 22 is placed along the lower face of the housing bottom wall 4.

As a rear view of the housing 2 in FIG. 3 shows, when the confirmation opening 17 in the center of the housing rear wall 6 is seen in a horizontal direction from the rear or the just rear, the lower inclined faces 15*b* of the left and right arm portions 15 of the lock arm 8 which is in a free state and the rear end face 12*a* of the lock wall 12 in the center are visually confirmed. Parts 27 of the connecting wall 12 connecting the leg portions 11 are seen as being situated outwards of the lower inclined faces 15*b* of the arm portions 15 between left and right ends of the confirmation opening 17. The parts 27 are bent-back portions between the arm portions 15 and the leg portions 11.

Figure 5:
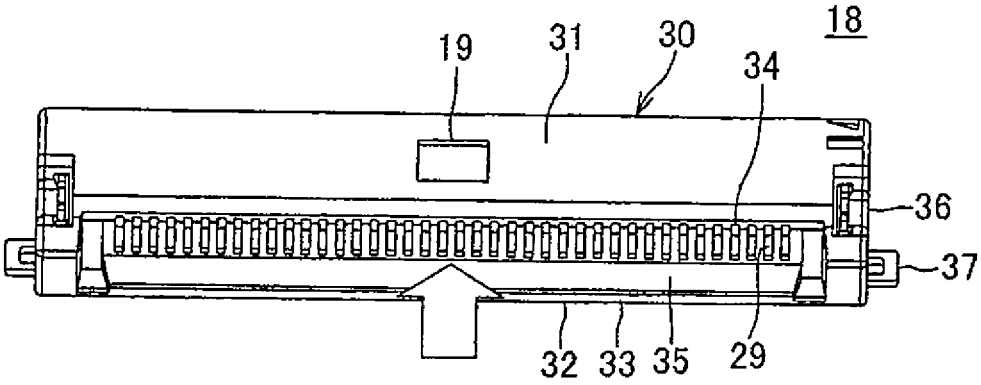
FIG. 5 is a plan view of an embodiment of a circuit-board-side connector as viewed from slightly obliquely above.

FIG. 4 shows a prefitting state in which the flat-circuit-element-side connector 1 including the housing 2 is fittingly connected to the circuit-board-side connector 18 in a direction indicated by an arrow, and FIG. 5 shows the circuit-board-side connector 18. An arrow in FIG. 5 denotes the fitting direction of the flat-circuit-element-side connector 1.

As shown in FIG. 4, the flat-circuit-element-side connector 1 includes the housing 2, the substantially recess-shaped cover 26 and a terminal portion of the flat circuit element 22 which is fixedly held between the housing 2 and the cover 26. The cover 26 includes a lower wall and side walls 26*a*, and opening portions in the side walls 26*a* are locked on corresponding projections 28. Exposed conductor portions (not shown) are positioned side by side on a lower face of the terminal portion of the circuit element 22 and are connected to elastic contact portions of terminals 29 (FIG. 5) of the circuit-board-side connector 18. As the flat circuit element 22, FFC (flexible flat circuit element) or FPC (flexible printed circuit element) is adopted.

The circuit-board-side connector 18 includes a housing 30 formed of insulating resin and the plurality of terminals 29 which are made of conductive metal. The housing 30 has a laterally elongated connector insertion port 33 between upper and lower horizontal wall portions 31, 32. The front-half projecting portion 4*a* of the bottom wall 4 of the flat-circuit-element-side connector 1 is inserted into the connector insertion port 33, whereby the exposed conductor portions at the terminal portion of the flat circuit element 22 are brought into contact with the corresponding elastic contact portions (not shown) of the terminals 29 which are disposed on the housing lower wall 32.

As shown in FIG. 5, the lock projection 19 is provided at the center of the upper wall 31 of the circuit-board-side connector 18, and as shown in FIG. 4, the lock projection 19 has a vertical locking face 19*b* on a front side and an inclined face 19*a* on a rear side. Terminal grooves 34 for positioning and holding upper portions of the corresponding terminals 29 and a distal end side inclined face 35 are formed at a rear portion of the housing upper wall 31 in FIG. 5. The connector insertion port 33 is opened on a lower side of the inclined face 35. The circuit-board-side connector 18 is fixed to a circuit board 38 (FIG. 4) by means of screwing or soldering at metallic fixing portions 37 on lower sides of left and right side walls 36 of the circuit-board-side connector 18, and the terminals 29 are soldered to respective circuits of the circuit board 38. The circuit board 38 is a PCB (Printed Circuit Board).

Figure 6:
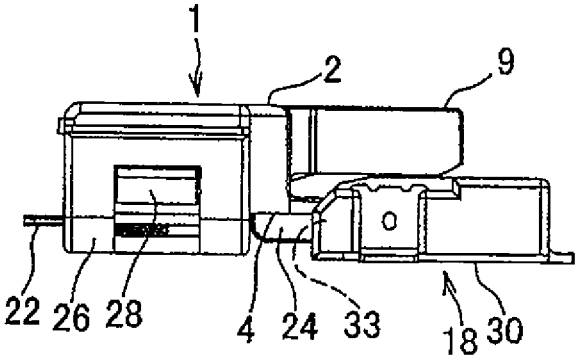
FIG. 6 is a side view showing an incomplete fitting state in a midst of fitting both the connectors together.
Figure 7:
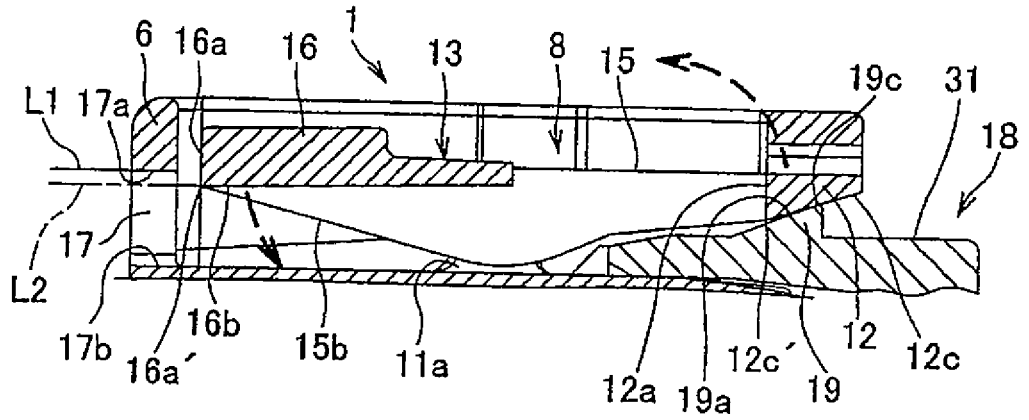
FIG. 7 is a vertical sectional view showing a deflected state of a lock arm in the midst of fitting both the connectors together.

FIGS. 6 to 8 show an intermediate state of fitting the flat circuit body side connector 1 and the circuit-board-side connector 18 together.

As shown in FIG. 6, the front-half portion 4*a* of the bottom wall 4 of the flat-circuit-element-side connector 1 is inserted into the connector insertion port 33 in the housing 30 of the circuit-board-side connector 18. In FIG. 6, reference numeral 24 denotes an elongated guide projection provided on each of left- and right-hand sides of the front-half portion 4*a* of the bottom wall 4, 22 denotes the flat circuit board, 26 the cover, 2 the housing, and 9 the arm protection wall on the upper portion of the front-half portion of the housing.

As shown in FIG. 7, the inclined face 19*a* of the lock projection 19 on the housing upper wall 31 of the circuit-board-side connector 1 presses upwards the lock wall 12 as indicated by an arrow while sliding along the lower inclined face 12*c* of the lock wall 12 at the front end of the lock arm 8 of the flat-circuit-element-side connector 1. Thus, the operation plate portion 16 at the rear end side of the operation arm 13 which is integrated with the lock wall 12 rotates downwards as indicated by an arrow around the root portions 11*a* of the leg portions 11 as fulcrums, whereby the lower face 16*b* of the operation plate portion 16, that is, a lower end of the rear end face 16*a* of the operation plate portion 16 comes to be situated further downwards than the upper end face 17*a* of the confirmation opening 17. A horizontal extension of the upper end face 17*a* of the confirmation opening 17 is referred to as L1, and a horizontal extension of a lower end 16*a*' of the rear end face 16*a* of the operation plate 16 is referred to as L2.

Figure 8A:
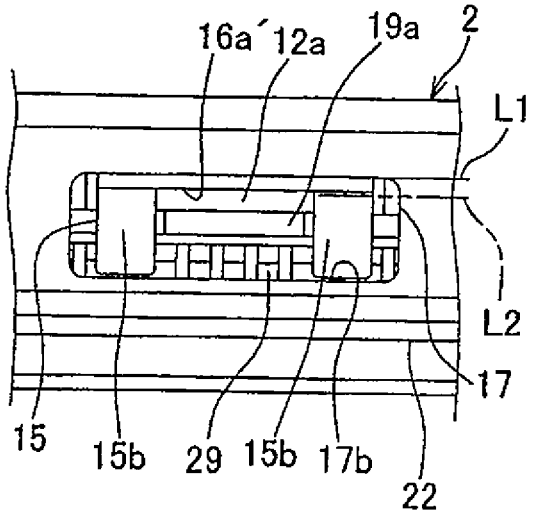
FIG. 8A is a rear view and FIG. 8B is a perspective view, both showing a state occurring within a confirmation opening in a rear wall of a housing in the midst of fitting both the connectors together.
Figure 8B:
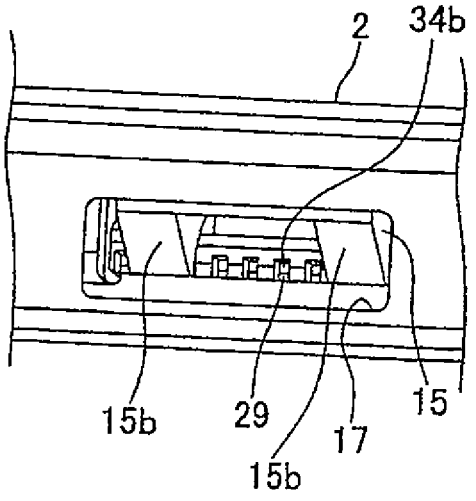

Then, as is shown in FIGS. 8A, 8B, when looking at the confirmation opening 17 in the housing 2 from the just rear thereof, the lower end portion 16*a*' of the operation plate portion 16 of the lock arm 8 is visually confirmed as extending horizontally long on an upper side of the lower inclined faces 15*b* of the left and right arm portions 15. FIG. 8A is a rear view, and FIG. 8B is a rear perspective view.

FIGS. 8A and 8B correspond to FIG. 7, and FIG. 7 shows such a state that a top portion 19*c* of the lock projection 19 comes into contact with an intermediate position of the lower inclined face 12*c* of the lock wall 12. The lock projection 19 is brought into sliding contact with the lock wall 12 by pressing the flat-circuit-element-side connector 1 further in the inserting direction from the state shown in FIG. 7. Then, when the top portion 19*c* of the lock projection 19 is positioned at a lower end 12*c*' of the lock wall 12, the operation arm 13 of the lock arm 8 rotates through a maximum angle in a direction indicated by an arrow in FIG. 7, whereby the whole or almost the whole of the rear end face 16*a* of the operation plate portion 16 is positioned within the confirmation opening 17 so as to be visually confirmed. In other words, the rear end face 16*a* of the operation plate portion 16 is exposed to a rear outside of the housing 2 of the flat-circuit-element-side connector 1 through the confirmation opening 17, only in a state where the lock arm 8 is deflected.

The rear end face 16*a* of the operation plate 16 is invisible when the lock arm 8 is in a free state shown in FIG. 3. In the event that the rear end face 16*a* of the operation plate portion 16 is visually confirmed when the worker looks at the inside of the mold removal hole 17 after he or she has fitted the connectors 1, 18 together, it is recognized that both the connectors 1, 18 are in the midst of being fitted together or are not fitted together completely as is shown in FIGS. 6, 7. The worker inserts strongly the flat-circuit-element-side connector 1 into the circuit-board-side connector 18 again so that both the connectors 1, 18 are fitted together completely.

In FIGS. 8A, 8B, within the confirmation opening 17, the rear end face 12*a* of the lock wall 12 and part of the inclined face 19*a* of the lock projection 19 lying therebelow are positioned between the left and right arm portions 15 below the operation plate portion. However, these are spaced farther to the front than the rear end face 16*a* of the operation plate portion 16, although they can eventually be visualized, it is difficult to visualize them properly. Rather, the lower inclined faces 15*b* of the left and right arm portions 15 are lowered to be positioned on the lower end face 17*b* side of the confirmation opening 17 within the confirmation opening 17. Therefore, the lower inclined faces 15*b* become easily visible together with the lower portion 16*a*' of the operation plate portion 16. In FIG. 8, reference numeral 34 denotes a terminal groove in the housing upper wall 31 of the circuit-board-side connector 18, 29 an upper portion of the terminal, and 22 the flat circuit element.

FIGS. 9 to 11B show a state in which the flat-circuit-element-side connector 1 and the circuit-board-side connector 18 are fitted completely.

Figure 9:
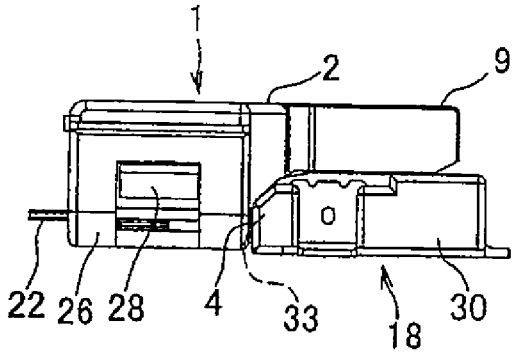
FIG. 9 is a side view showing a state resulting when both the connectors are fitted together completely.

As shown in FIG. 9, the first-half projecting portion 4*a* of the housing bottom wall 4 of the flat-circuit-element-side connector 1 is inserted completely into the connector insertion port 33 in the circuit-board-side connector 18 together with an end portion of the flat circuit element 22. In FIG. 9, reference numeral 26 denotes the cover, 2 the housing, and 9 the arm protection wall of the first-half upper portion of the housing 2.

Figure 10:
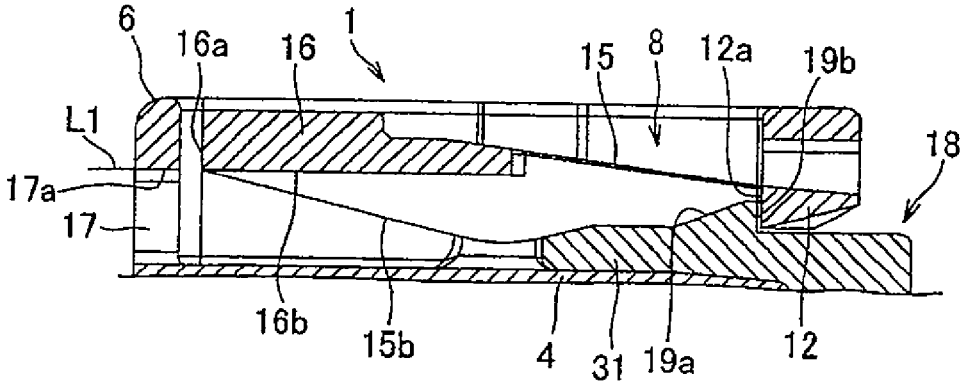
FIG. 10 is a vertical sectional view showing a state of the lock arm when both the connectors are fitted together completely.

As is shown in FIG. 10, the housing upper wall 31 of the circuit-board-side connector 18 is inserted completely in the space defined between the housing bottom wall 4 of the flat-circuit-element-side connector 1 and the lock arm 8, and the lock projection 19 on the housing upper wall 31 passes the lock wall 12 of the lock arm 8, in other words, the lock wall 12 rides over the lock projection 19. Then, the vertical front end face 19*b* of the lock projection 19 approaches the rear end face 12*a* of the lock wall 12 so as to be ready for abutment therewith or comes almost into abutment with the rear end face 12*a*. Thus, the lock arm 8 is restored to the free state shown in FIG. 2, and the lower face 16*b* of the operation plate portion 16 comes to be positioned on the same plane as the upper end face 17*a* of the confirmation opening 17 in the housing rear wall 6. A rearward extension of the upper end face 17*a* is shown as L1.

Figure 11A:
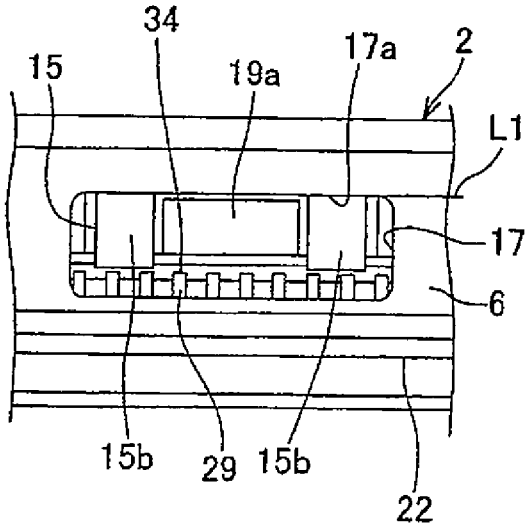
FIG. 11A is a rear view and FIG. 11B is a perspective view, both showing a state occurring within the confirmation opening in the rear wall of the housing when both the connectors are fitted together completely.
Figure 11B:
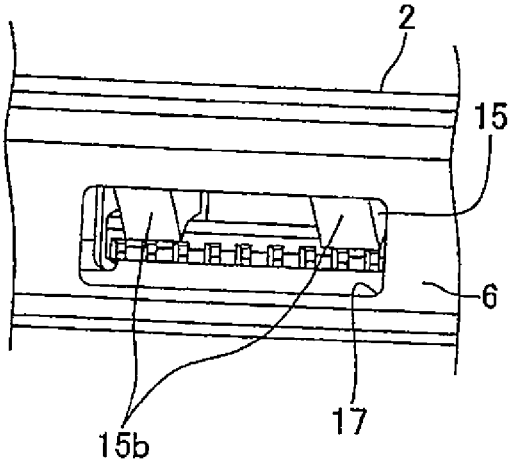
Figure 12:
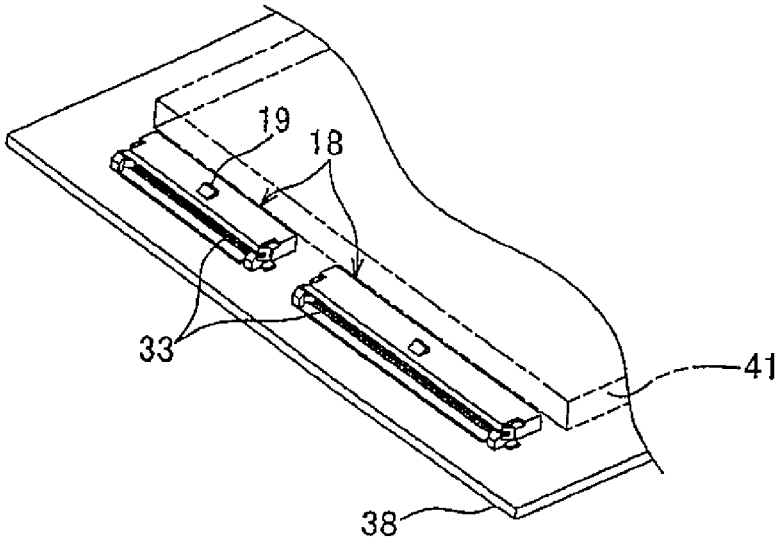
FIG. 12 is a perspective view showing an example of a form in which circuit-board-side connectors are disposed.
Figure 13:
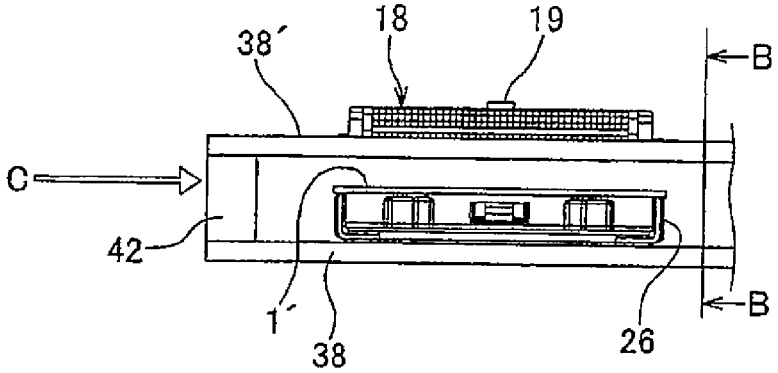
FIG. 13 is a rear view showing another example of a form in which circuit-board-side connectors or the like are disposed.
Figure 14:
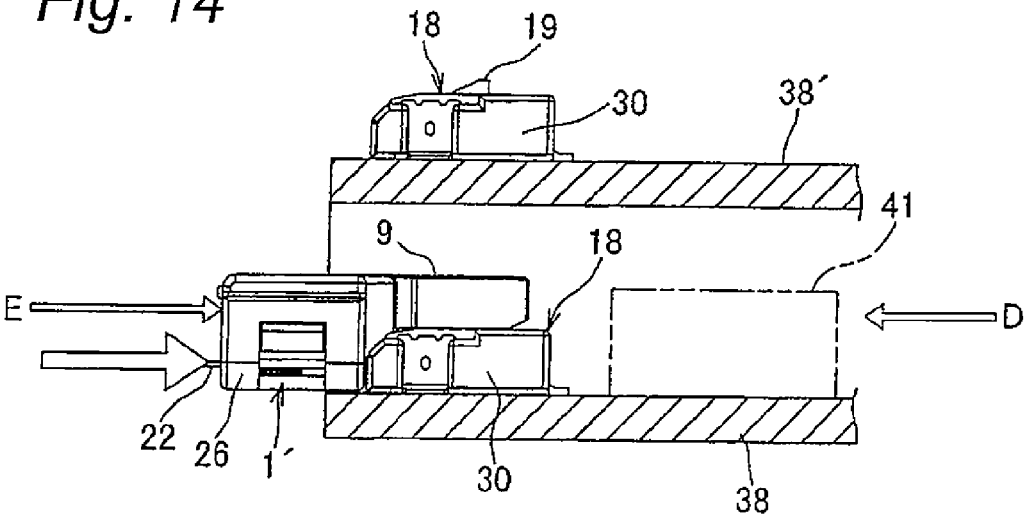
FIG. 14 is a sectional view taken along the line B-B in FIG. 13 showing the other example of a form in which the same connectors are disposed.

As is shown in FIGS. 11A, 11B, when looking at the confirmation opening 17 from the just rear thereof, the rear end face 16*a* (FIG. 10) of the operation plate portion 16 of the lock arm 8 is not shown at all within the confirmation opening 17, and the lower inclined faces 15*b* of the left and right arm portions 15 are seen as being closer to the upper end face 17*a* of the confirmation opening 17 than in FIGS. 8A and 8B. FIGS. 8A and 8B show the midst of fitting the connectors together, that is, the state where the connectors are fitted together incompletely. In case this is looked at with care, the rear side inclined face 19*a* of the lock projection 19 which is seen as lying father away forwards between both the arm portions 15 is seen larger in the vertical direction than in FIGS. 8A and 8B. In FIGS. 11A and 11B, reference numeral 34 denotes the terminal groove at the rear portion of the housing of the circuit-board-side connector 18 and reference numeral 29 denotes the upper portion of the terminal. In FIGS. 11A and 11B in which the connectors are fitted together completely, the terminal groove 34 is positioned on the lower side of the lower inclined faces 15*b* of the left and right arm portions 15, while in FIGS. 8A and 8B, part of the terminal groove 34 is covered to become invisible by the lower inclined faces 15*b* of the left and right arm portions 15.

In this way, it can easily be determined whether both the connectors 1, 18 are fitted together completely or incompletely based on whether or not the worker can visually confirm the rear end face 16*a* of the operation plate portion 16. As this occurs, the change in position of the lower inclined faces 15*b* of the pair of left and right arm portions 15 or whether or not the lock projection 19 looks larger will help make such a determination.

The connectors fitting connection confirmations illustrated in FIGS. 8A, 8B, 11A and 11B become effective when the front, top or sides of the locked portion between the circuit-board-side connector 18 and the flat-circuit-element-side connector 1 become invisible for confirmation due to the obstacles such as an other circuit board package part 41, an upper circuit board 38' or connecting walls of upper and lower circuit boards 38, 38'. Even when these obstacles do not exist, in the event that the locked state between the connectors cannot be implemented from the front, top or sides depending on the position where the worker stands who is performing the connector fitting operation, the aforesaid fitting confirmation construction and a method thereof become effective.

In the embodiment described heretofore, while whether or not the connectors are fitted together properly is determined with respect to the circuit board connecting connector which is made up of the flat-circuit-element-side connector 1 and the circuit-board-side connector 18, in addition to the circuit board connecting connector, as a connector to which the invention can be applied, the following connector can also be adopted. Namely, when a connector connected to a normal wiring harness (a plurality of electric wires as a circuit) is inserted to be fitted to a connector for direct connection to equipment, for example, in the event that the front, top or sides of the equipment direction connection connector are invisible for confirmation due to obstacles, it becomes possible to confirm the proper fitting of both the connectors in the same way as that described above by providing a confirmation opening 17 in a rear wall of a housing of the wiring harness side connector and a lock projection 19 on a housing of the equipment direct connection connector.

The configuration of the invention that has been described heretofore is effective not only as the fitting confirmation construction but also as a connectors fitting connection confirmation method.

The fitting confirmation construction can be made use of to implement easily and in an ensured fashion a connectors fitting connection confirmation between two connectors for connecting circuit boards or wiring harnesses, for example, from the rear to avoid obstacles.

What is claimed is:

1. A fitting confirmation construction for confirming a connection between a first connector and a second connector, the fitting confirmation construction comprising:

a lock arm, provided in a housing of the first connector, and including: a lock wall inclined and disposed at a front end of the lock arm in a direction from the first connector toward the second connector;

a deflection space formed at a rear of the lock wall in the direction; and an operation plate disposed on the deflection space;

a confirmation opening, provided in a rear wall of the housing, and having a height equal to a height of the deflection space; and a lock projection, provided on the second connector, and configured to be brought into engagement with the lock wall, wherein a rear end face of the operation plate is exposed to a rear outside of the housing of the first connector through the confirmation opening, only in a first state where the lock arm is deflected, and a lower end face of the operation plate is positioned on a same plane as an upper end of the confirmation opening, in a second state where the lock arm is undeflected.

2. The fitting confirmation construction according to claim 1, wherein the lock arm includes a right arm and a left arm which connect the lock wall with the operation plate respectively, and lower inclined faces of the right arm and the left arm are exposed to the rear outside through the confirmation opening at a lower end side of the confirmation opening, only in the state where the lock arm is deflected.

3. The fitting confirmation construction according to claim 1, wherein the confirmation opening is a mold removal cavity.

4. The fitting confirmation construction according to claim 1, wherein the first connector is a flat circuit element side connector, and the second connector is a circuit board side connector.

5. The fitting confirmation construction according to claim 1, wherein the plane extends in the direction and is perpendicular to the height of the confirmation opening.

6. The fitting confirmation construction according to claim 1, wherein the second state occurs both before insertion of the second connector into the first connector and while the second connector is fully inserted into the first connector, and the first state occurs after insertion of the second connector into the first connector and before the second connector is fully inserted into the first connector.

* * * * *